US005181377A

United States Patent [19]

Napoli et al.

[11] Patent Number: 5,181,377

[45] Date of Patent: Jan. 26, 1993

[54] DAMPED COMBUSTOR COWL STRUCTURE

[75] Inventors: Phillip D. Napoli, West Chester; John M. Koshoffer, Greenhills, both of Ohio

[73] Assignee: General Electric Company, Cincinnati, Ohio

[21] Appl. No.: 685,947

[22] Filed: Apr. 16, 1991

[51] Int. Cl.[5] ..... F02C 1/00; F02G 3/00

[52] U.S. Cl. ..... 60/39.31; 60/39.32; 60/752

[58] Field of Search ..... 60/39.31, 39.32, 39.36, 60/725, 752, 756; 431/350, 353

[56] References Cited

U.S. PATENT DOCUMENTS

| | | | |
|---|---|---|---|
| 3,064,425 | 11/1962 | Hayes | 60/39.65 |
| 3,775,975 | 12/1973 | Stenger et al. | 60/39.32 |
| 3,842,595 | 10/1974 | Smith et al. | 60/39.32 |
| 3,854,285 | 12/1974 | Stenger et al. | 60/39.66 |
| 3,990,232 | 11/1976 | Campbell | 60/39.66 |
| 4,050,241 | 9/1977 | DuBell | 60/39.66 |
| 4,191,011 | 3/1980 | Sweeney et al. | 60/39.32 |
| 4,194,358 | 3/1980 | Stenger | 60/39.36 |
| 4,365,470 | 12/1982 | Matthews et al. | 60/39.32 |
| 4,555,901 | 12/1985 | Wakeman et al. | 60/39.32 |
| 4,614,082 | 9/1986 | Sterman et al. | 60/39.32 |
| 4,686,823 | 8/1987 | Coburn et al. | 60/752 |
| 4,785,623 | 11/1988 | Reynolds | 60/39.36 |
| 4,848,089 | 7/1989 | Cramer | 60/39.32 |
| 4,887,663 | 12/1989 | Auxier et al. | 165/47 |
| 4,944,151 | 7/1990 | Hovananian | 60/39.32 |

FOREIGN PATENT DOCUMENTS

| | | |
|---|---|---|
| 0216721 | 4/1987 | European Pat. Off. . |
| 0803860 | 11/1958 | United Kingdom . |
| 1118257 | 6/1968 | United Kingdom . |

*Primary Examiner*—Richard A. Bertsch
*Assistant Examiner*—Howard R. Richman
*Attorney, Agent, or Firm*—Jerome C. Squillaro; James P. Davidson

[57] ABSTRACT

A friction-damped combustor cowl is formed of first and second plies of sheet material of mating, generally annular configuration defining a central cowl axis and of axially elongated and aerodynamically contoured configuration have respective fore end portions which are curled to form a cowl leading edge of arcuate cross section and corresponding fore edges which are integrally joined, and respective aft end portions which define a cowl trailing edge and corresponding aft edges which are integrally joined. Surface contact of the contiguous surfaces of the laminated and mating first and second plies provides vibration damping under normal operating conditions in an alternative and combustor cowl, a spring element is received and maintained under compression within the curled leading edge of the combustor cowl and maintains a resilient biasing force maintaining surface contact between the spring element and the interior surface of the curled leading edge, thereby maintaining frictional surface contact and requisite vibration damping under normal operating conditions.

14 Claims, 5 Drawing Sheets

FIG. 1
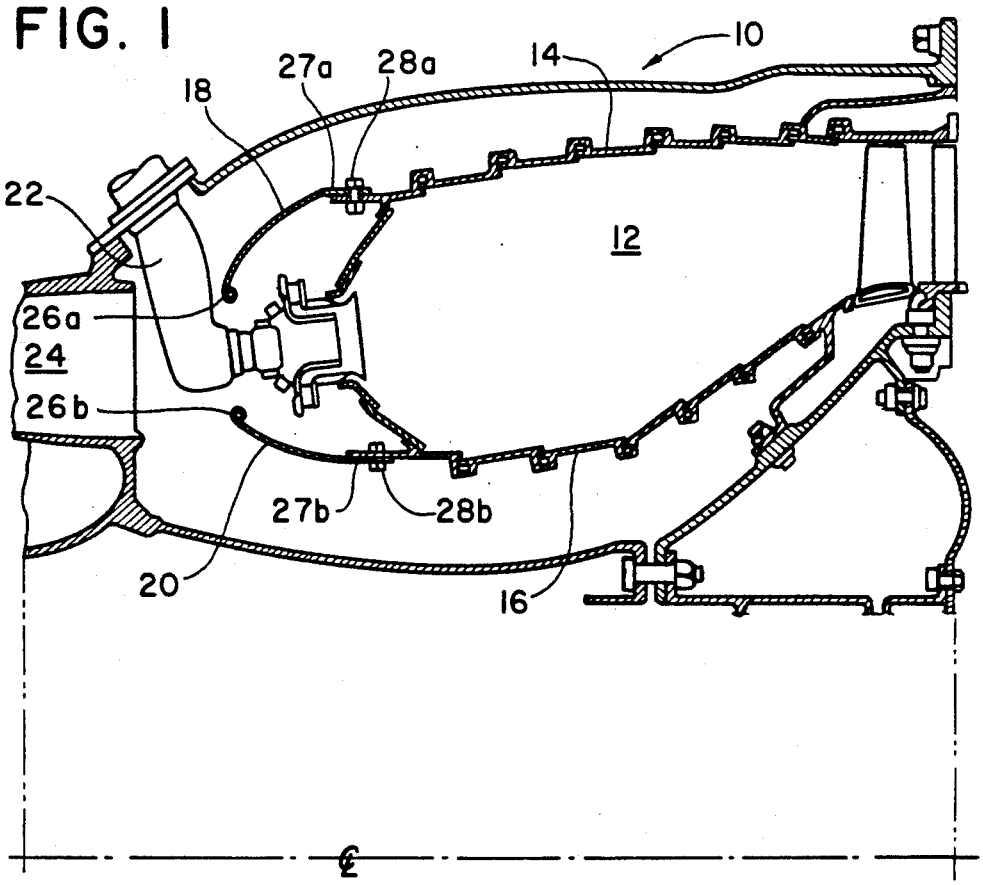
FIG. 2A
(PRIOR ART)
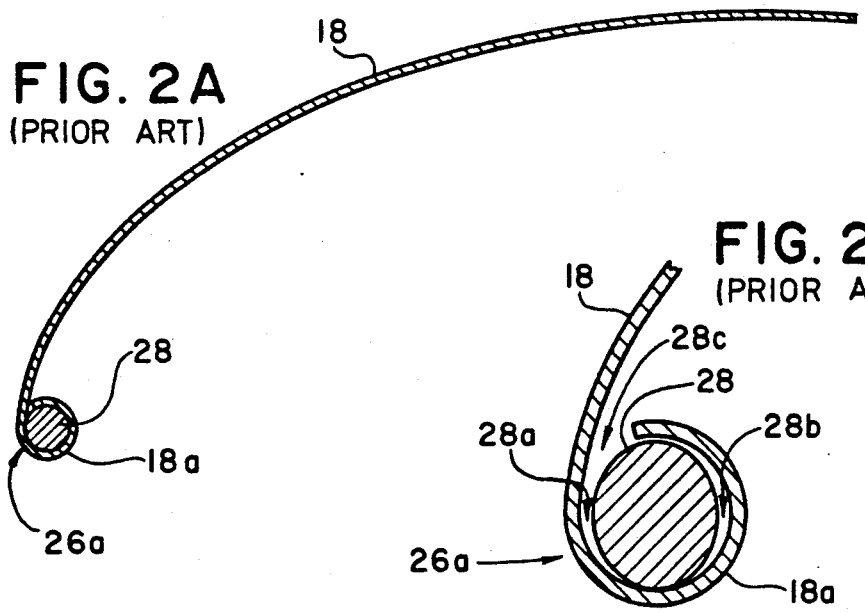
FIG. 2B
(PRIOR ART)

FIG. 3B
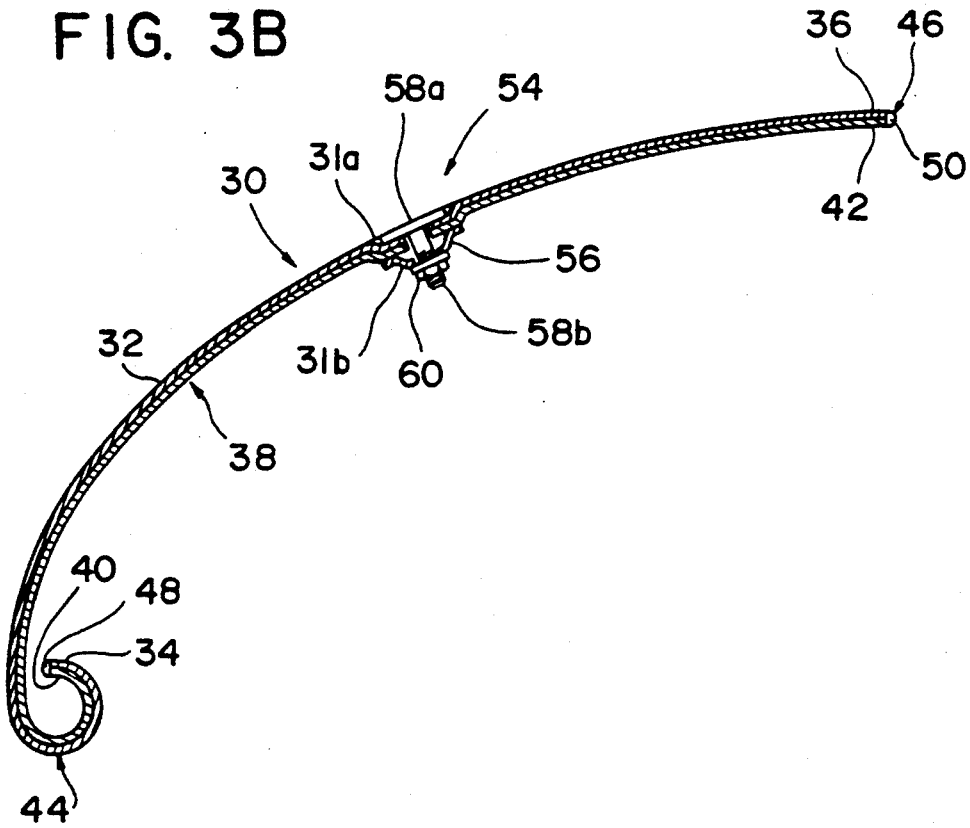
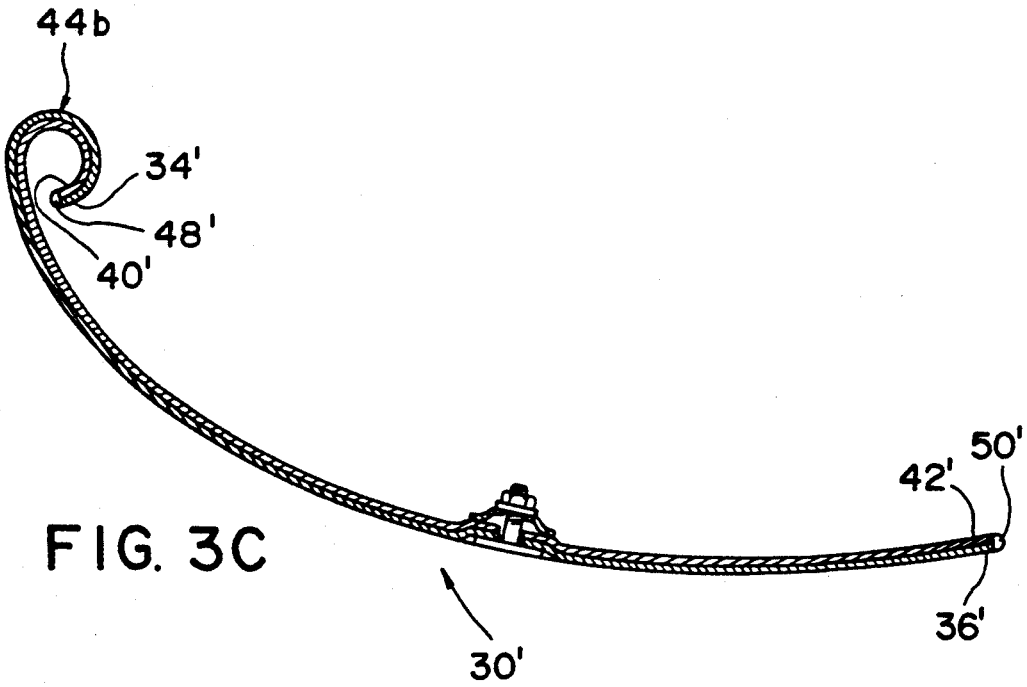
FIG. 3C

DAMPED COMBUSTOR COWL STRUCTURE

BACKGROUND OF THE INVENTION

1. Field of the Invention

The present invention relates generally to gas turbine engines and, more specifically, to an improved cowl damping structure for use in the combustion chamber of such an engine.

2. Description of the Related Art

In an annular-type combustor of a gas turbine engine, pressurized air from the compressor is directed by guide vanes over the inner and outer liners of the combustion chamber, or combustor, to provide a cooling effect.

As shown in FIG. 1, a typical combustor 10 includes a combustion chamber 12 of generally annular configuration, as defined by an outer liner 14 and an inner line 16 of the chamber 12, each of the liners 14 and 16 being of a generally cylindrical configuration throughout at least a portion of the axial extent thereof, relatively to a central axis, or line ("C/L"), of the combustor 10 and thus of the gas turbine engine in general. The outer and inner cowls 18 and 20 are assembled with the chamber 12 by connecting their respective trailing edges 27*a* and 27*b* to the outer and inner liners 14 and 16, respectively, illustratively by bolts 28*a* and 28*b* and associated nuts. The leading edges 26*a* and 26*b* of the cowls 18 and 20 are thereby positioned in the vicinity of the fuel nozzles 22 and define therebetween a generally annular opening whereby compressed air is directed by guide vanes 24 through and around the cowls 18 and 20.

The cowls 18 and 20 accordingly are subjected to a very hostile environment, being impacted by chaotic perturbations in the impinging compressed air flow from the compressor and which in turn produce mechanical vibration of the cowls. Vibration resulting from these normal and unavoidable, adverse operating conditions produces high cycle fatigue of the cowls 18 and 20 and thus a life-shortening failure mechanism. Thus, vibration damping techniques have been developed to reduce the deleterious and life-shortening effects of such vibration.

One reasonably effective, prior art vibration damping technique, shown in FIG. 2(A) illustratively for the leading edge 26*a*, is to roll the fore end 18*a* of the sheet metal cowl 18 around and thereby partially encase a continuous, solid core wire 28; this structure produces a torsional frictional force between the contiguous, inner surface of the fore end 18*a* and the outer surface of the wire 28 and provides friction damping of the vibration.

Over long term exposure to the harsh operating conditions of the combustor, however, the wire-damped cowls are subject to the typical wear problems associated with friction (i.e., static part) damping. As shown in FIG. 2(A), the accumulated effects of wear result in the production of gradually increasing gaps 28*a* and 28*b* between the initially engaged contact surfaces. The frictional wear initially produces thinning of the wire 28 and/or the fore end 18*a*, followed by wire impact loading which alters the encased relationship, opening a further gap 28*c* (FIG. 2(B), the cumulative effects not only degrading the intended level of friction damping but also leading to shortened life and thus requiring more frequent replacement of the cowls is desired. Component testing of combustor cowls shows that the output response over a frequency range of new cowls varies significantly, the variation being attributable to manufacturing tolerances, required for reproducibility, in forming the leading edge 26*a*. Data from field cowls show a much higher output response than for new cowls, a result indicative of the degradation of the damping characteristic of the rolled wire leading edge as a function of the time of use. Inspection of damping wires from failed field parts has revealed wear of the respective contact areas of the damping wire and the rolled sheet metal.

Thus, a continuing need exists for a combustor cowl having means for damping vibrations which occur during normal operating conditions.

SUMMARY OF THE INVENTION

An object of the present invention is to provide an improved combustor cowl having improved vibration damping characteristics and prolonged life.

Another object of the present invention is to provide an improved combustor cowl which is relatively simple in construction and cost effective to produce.

These and other objects of the invention are met by providing a combustor cowl for use in the combustor of a gas turbine engine which comprises a first ply of sheet metal having fore and aft end portions and corresponding edges and a second ply of sheet metal in surface contact with the first ply and having fore and aft end portions and corresponding edges; the respective fore edges of the first and second plies are integrally joined and the respective fore end portions are curled to form a cowl leading edge of arcuate cross-section, and the respective aft end portions of the first and second plies extend in contiguous, or overlying, relationship and the respective aft edges thereof are integrally joined to form a trailing edge. The frictional surface contact of the first and second plies affords vibration damping under normal operating conditions of the gas turbine engine.

In another embodiment of the present invention, a combustor cowl comprises a single ply of sheet metal having fore and aft end portions, a convex outer surface and a concave inner surface, the fore end portion being curled to form a leading edge of arcuate cross-section and the aft end portion providing a trailing edge, and a spring element disposed in, and resiliently self-biased into surface contact with the inner surface of, the curled leading edge and providing frictional damping of the vibrations resulting from normal operating conditions of the gas turbine engine. Preferably, the spring element is a hollow, longitudinally split metal tube having a C-shape in cross section. The spring element is maintained in compression by, and thus within, the curled leading edge and thereby exerts an outward force, ensuring that surface contact between the outer surface of the split tube and the inner surface of the curled leading edges, and thus the requisite frictional damping, is maintained over the intended life time of the components.

BRIEF DESCRIPTION OF THE DRAWINGS

FIG. 1 is a partial longitudinal section view of a gas turbine engine showing a portion of a combustor employing a prior art cowl;

FIG. 2(A) is an enlarged longitudinal section view of the prior art cowl of FIG. 1;

FIG. 2(B) is a further enlarged, longitudinal section view of the leading edge of the cowl of FIGS. 1 and 2, illustrating wear-induced formation of gaps between the sheet metal and the wire;

FIG. 3(B) is a cross-sectional view of the outer cowl of FIG. 3(A) taken in a plane along the line 3(B)—3(B) in FIG. 3(A) and corresponding to the longitudinal section views of FIGS. 1 and 2(A);

FIG. 3(C) is a cross-sectional view, taken in a plane corresponding to that of FIG. 3(B), of a fragmentary section of an outer cowl according to the first embodiment of the invention;

DETAILED DESCRIPTION OF THE PREFERRED EMBODIMENT

Figure 3A:
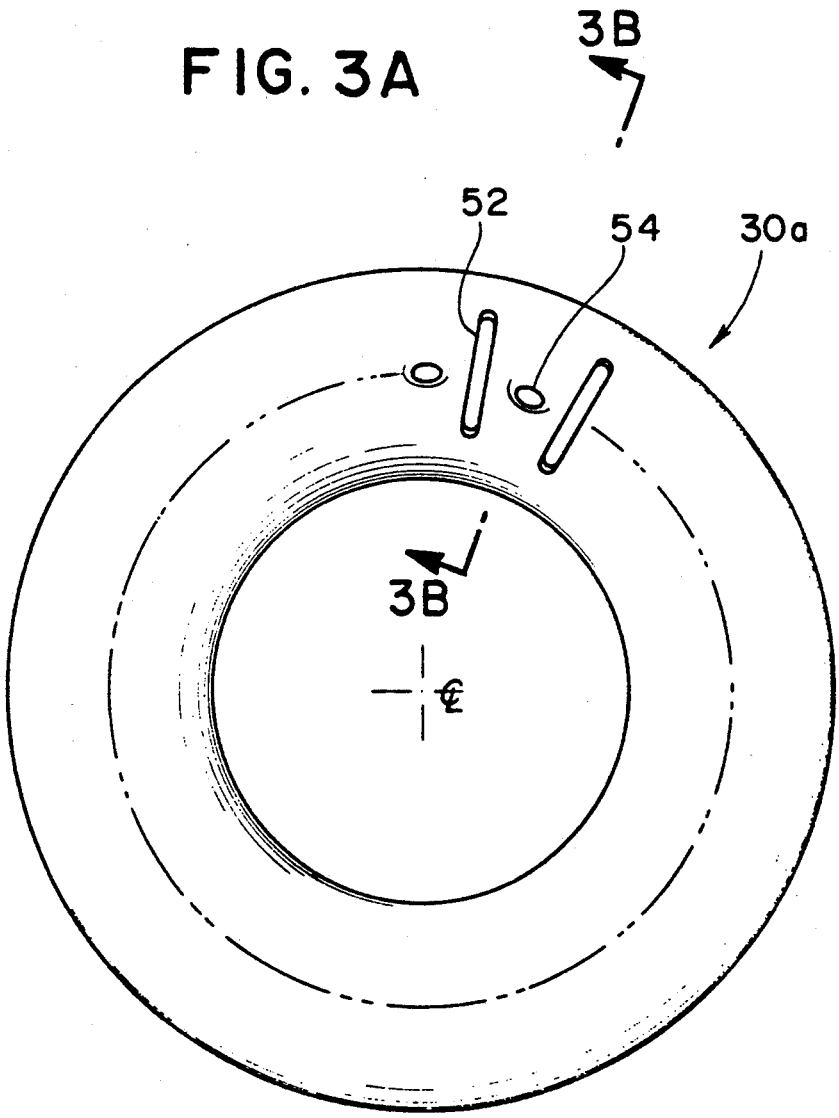
FIG. 3(A) is a front elevation view of an outer cowl according to a first embodiment of the invention.

FIGS. 3(A) and 3(B) are front elevation and cross-sectional views, respectively, the latter in a plane taken along line 3B—3B in FIG. 3(A), of an outer cowl 30 in accordance with the first embodiment of the invention, the associated inner cowl 30' and its components being shown in fragmentary section only, in a corresponding cross-sectional view with corresponding parts thereof identified by identical but primed numerals, to facilitate the following description.

Particularly, the outer cowl 30 comprises a first ply 32 of sheet metal having a fore end portion 34 and an aft end portion 36, and a second ply 38 of sheet metal disposed in surface contact with the first ply 32 and also having a fore end portion 40 and an aft end portion 42. The respective fore end portions 34 and 40 of the first and second plies 32 and 38 are curled together to form a cowl leading edge 44 of generally arcuate cross-section in a plane extending radially from a central axis of the cowl 30 (i.e., corresponding to the center line C/L in FIG. 1) and the corresponding fore edges are integrally connected, such as by a continuous weld 48 or brazing. The respective aft end portions 36, 42 extend in contiguous, or overlying, relationship and the corresponding aft edges are integrally joined, such as by a continuous weld 50, and define the trailing edge 46 of the cowl 30.

The cowl 30 thus is of a two-ply, laminate configuration, the leading edge 44, by virtue of its curled configuration and thus generally arcuate cross section, having the requisite structural strength and stability and the extensive surface contact between the mating, contiguous surfaces of the plies 32 and 38 affording the requisite frictional, static damping. The cowl of this embodiment accordingly eliminates not only the need for prior art wire-type dampers but also the susceptibility thereof to varying effectiveness as a result of manufacturing tolerances and to the advancing degradation of effectiveness as a result of the failure mechanisms before-described.

Figure 4A:
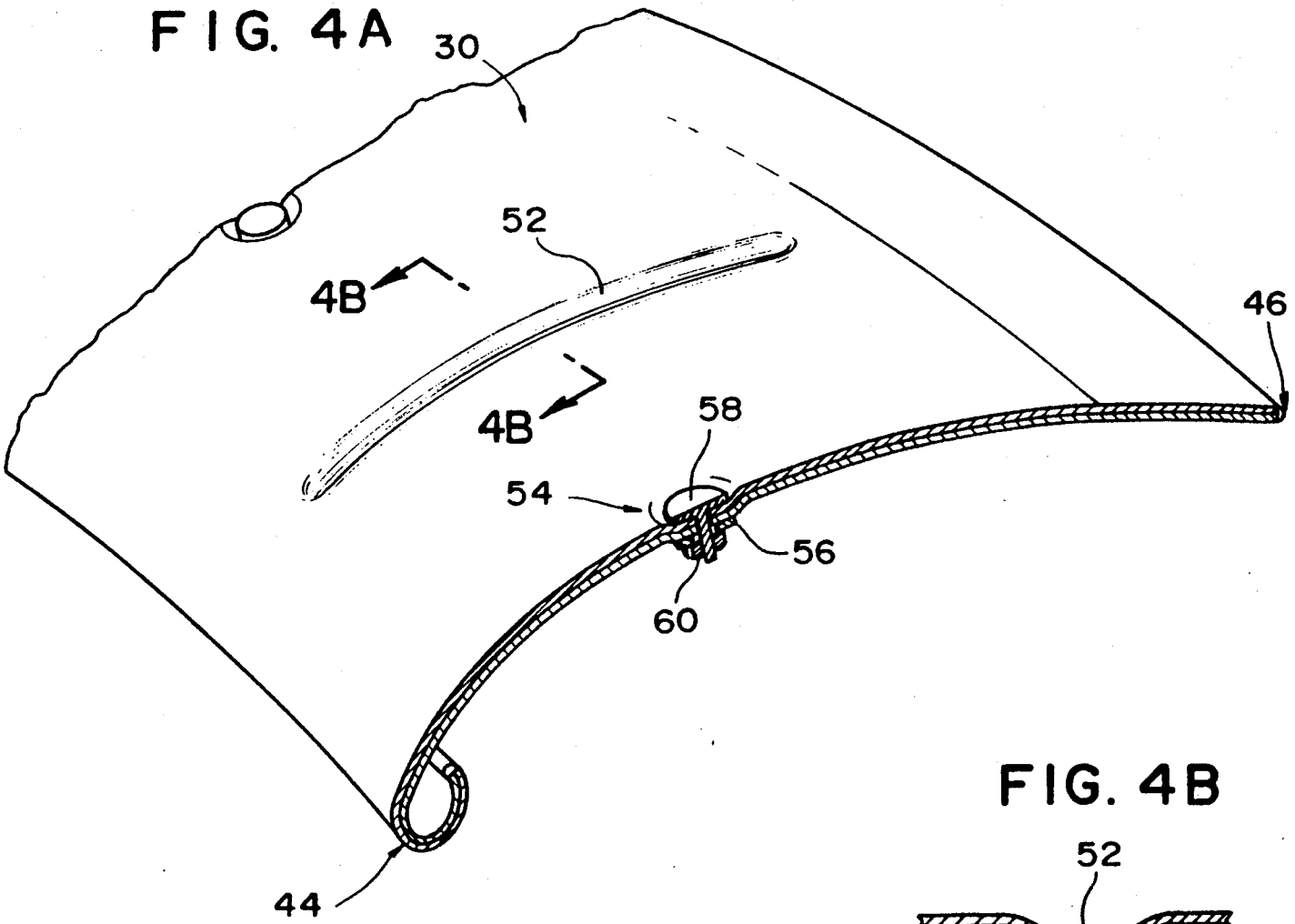
FIG. 4(A) is a perspective view of a portion of the outer cowl of FIGS. 3(A) and 3(B)
Figure 4B:
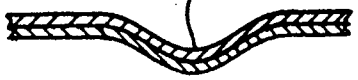
FIG. 4(B) is a sectional view taken along line 4B—4B of FIG. 4(A)

As shown in FIGS. 3(A), 4(A) and 4(B), the cowl 30 may include a plurality of axially extending surface deformations, such as corrugations 52, formed by stamping the sheet metal at a corresponding plurality of angularly spaced intervals. The deformations provide additional structural stiffness which in turn increases the frequency response of the cowl 30, beyond the operational speed and acoustic frequency range of the turbine engine.

The frequency damping characteristic of cowl 30 may be further enhanced by the provision of a plurality of spring loading elements 54 for ensuring that surface contact is maintained between the plies 32 and 38. As shown in FIG. 3(B), the illustrative element 54 comprises a bolt having a head 58*a* which is accommodated within a recess 31*a* in the convex outer surface of the cowl 30 so as to be flush with that outer surface thereby to satisfy aerodynamic design requirements including minimization of aerodynamic losses and avoidance of turbulence in the outer flow path passages of the combustor 10. The threaded shaft 58*b* of the bolt passes through an opening 31*b* in the cowl 30 and receives thereon a spring washer 56 which is maintained under tension against the inner surface of ply 38 by a nut 60 threadingly engaged on the bolt. Adjustment of the nut 60 permits adjustment of the level of resilient loading produced by element 54 for maintaining the plies 32 and 38 in surface contact. The plurality of elements 54 are spaced at a corresponding plurality of angularity displaced intervals around the cowl 30, and may be in alternating relationship with the plurality of corrugations 52 when the latter are also employed, the spacing and the number of each thereof being dependent on cowl/dome space limitations and allowable manufacturing dimensional tolerances that impact the contour of the cowl 30.

Figures 5A, 5B:
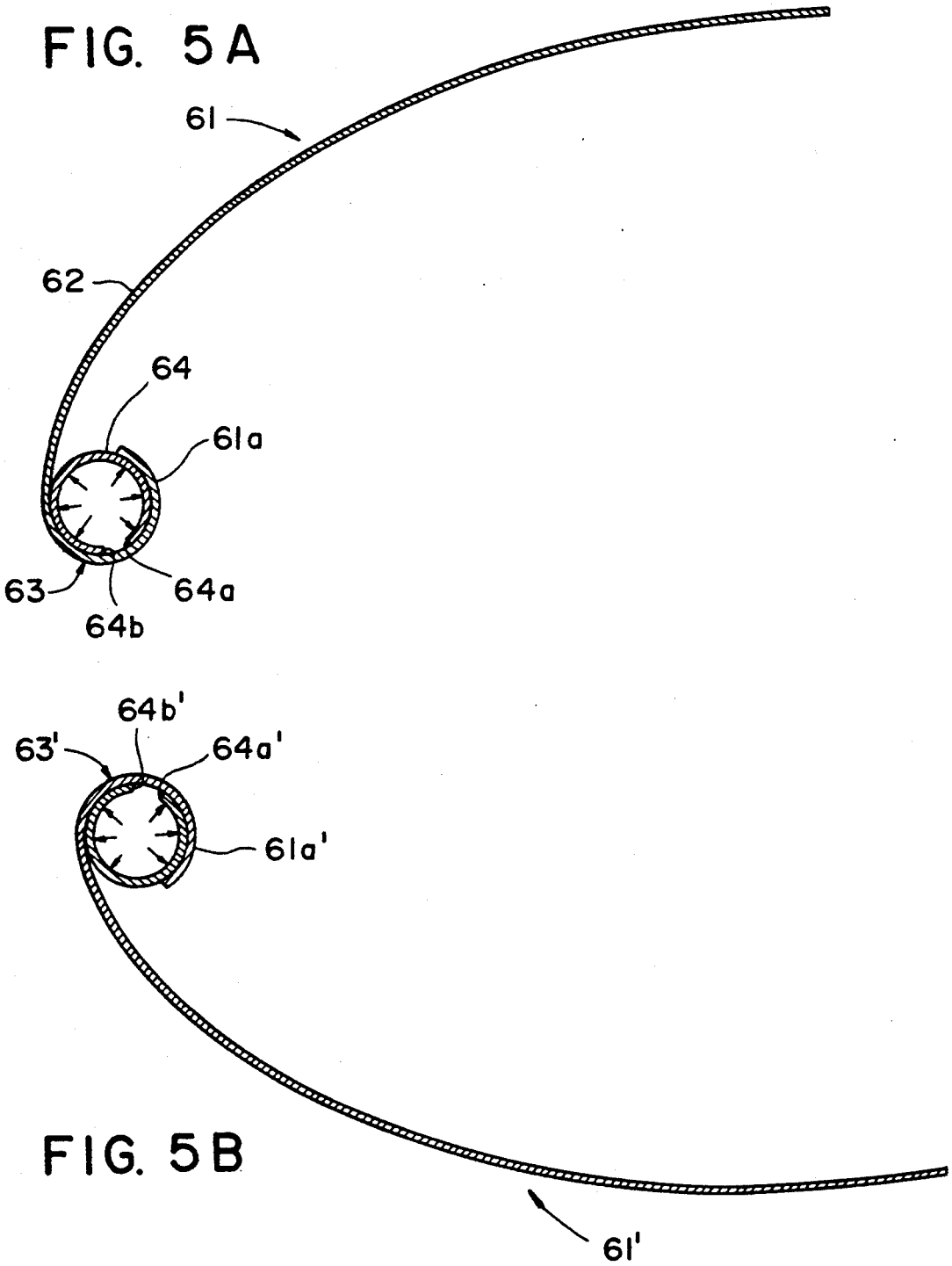
FIGS. 5A & 5B are longitudinal section views of a cowl in accordance with a second, preferred embodiment of the present invention.

In FIG. 5, in accordance with a second embodiment of the invention, an outer cowl 61 is formed of a single ply metal sheet 62 having a curled, or rolled, fore end defining the cowl leading edge 63 of generally circular configuration, in a plane transverse to the cowl central axis and of substantially arcuate cross-section in a plane extending radially from the cowl central axis. The inner cowl 61' is of corresponding configuration and the components thereof are identified by identical, but primed reference numerals and accordingly the following description is equally applicable thereto. A tubular spring element 64 of C-shaped cross section is positioned, under compression, within the curled leading edge 63, thereby to maintain a resilient, radially outwardly directed loading force as indicated by the radially oriented arrows illustrated in FIG. 5. Element 64 conveniently may be formed of a hollow metal tube having a longitudinal slit in the sidewall, parallel to the axis of the tube; the tube is compressed circumferentially, preferably to the limit permitted by the circumferential dimension of the slit (i.e., such that the opposing, parallel edges 64*a* and 64*b* of the slit are brought into abutment, and within yield limits of the metal at a maximum level of compression, and shaped as a substantially continuous, circular element alternatively, a plurality of arcuate segments, otherwise corresponding to the container tube, may be employed. The tubular element 64 as thus compressed and shaped then is disposed on the inner surface of the fore end of sheet 62 and functions as a mandrel, when curling the fore end of sheet 62 to form the leading edge 63. To the extent that vibration induces frictional wear between the outer surface of the tube 64 and the inner surface of the rolled, leading edge 63, corresponding circumferential expansion of the resilient element 64 avoids the creation of gaps, such as the gaps 28A and 28B of the prior art structure shown in FIG. 2(B), and thereby maintains the requisite friction damping while eliminating the wire impact loading failure mechanism of the prior art cowl damping structure.

In a further modification affording enhanced vibration damping, the first and second embodiments may be combined, the spring element 64 of FIG. 5 being utilized in the curled leading edge 44 of the laminate cowl 30 of FIG. 3B.

Numerous modifications and adaptations of the present invention will be apparent to those so skilled in the art and thus, it is intended by the following claims to cover all such modifications and adaptations which fall within the true spirit and scope of the invention.

What is claimed is:

1. A combustor cowl for use in assembled relationship with the combustor of a gas turbine engine, the cowl being of a generally annular configuration defining a central cowl axis and being axially elongated and aerodynamically contoured relative to the central cowl axis, the combustor defining a central combustor axis and the central cowl and combustor axes being aligned in the assembled relationship of the combustor cowl with the combustor, the combustor cowl comprising:

first and second plies of sheet metal respectively having generally annular and axially elongated and aerodynamically contoured configurations and each having inner and outer main surfaces and fore and aft end portions with corresponding fore and aft edges;

the first and second plies of sheet metal being assembled in mating relationship with the inner surface of the first ply of sheet metal disposed on and in surface contact with the outer surface of the second ply of sheet metal, the respective fore end portions of the first and second plies of sheet metal being curled together in a direction toward the interior surface of said second ply of sheet metal thereby to form a cowl leading edge, of a generally circular configuration in a plane transverse to and relating to the central cowl axis and of a generally arcuate cross-section in a plane extending radially from the central cowl axis, and the respective, corresponding fore edges being integrally joined, and the respective aft end portions of the first and second plies of sheet metal defining a cowl trailing edge and the respective, corresponding aft edges being integrally joined; and the surface contact of the first and second plies producing a frictional contact force affording friction damping of vibrations induced in the cowl under normal operating conditions of the gas turbine engine.

2. A combustor cowl according to claim 1, further comprising plural, axially elongated stiffening deformations formed in the assembled, first and second plies of sheet metal and spaced at corresponding angular intervals relative to the central cowl axis.

3. A combustor cowl according to claim 2, wherein the stiffening deformations comprise corrugations.

4. A combustor cowl according to claim 1, further comprising plural resilient biasing means, disposed intermediate the leading and trailing edges of the cowl and at corresponding angular intervals relative to the central cowl axis, for resiliently biasing the first and second plies of sheet metal into surface contact with each other.

5. A combustor cowl according to claim 4, wherein each of the resilient biasing means comprises aligned, respective openings in the first and second plies of sheet metal extending radially therethrough relatively to the central cowl axis, a bolt having a head and an integral, threaded shaft, a spring washer and a nut, the shaft of the bolt being received through the respective, aligned openings with the head engaging the outer surface of the first ply of sheet metal, the spring washer being received on the shaft and engaging the inner surface of the second ply of sheet metal and the nut being threadingly engaged on the shaft and tightened to engage and urge the spring washer against the inner surface of the second ply of sheet metal with a desired, resilient biasing force, thereby maintaining the surface contact of the first and second plies of sheet metal.

6. A combustor cowl according to claim 5, further comprising, for each of the resilient biasing means, a corresponding recess in the first and second plies of sheet metal, aligned with and extending laterally from the corresponding and respective, aligned openings therein and radially inwardly relatively to the central cowl axis, each recess being of sufficient lateral and depth dimensions for receiving the head of the bolt such that the head of the bolt is flush with the outer surface of the first ply.

7. A combustor cowl according to claim 4, further comprising plural, axially elongated stiffening deformations formed in the assembled, first and second plies of sheet metal and spaced at corresponding angular intervals relative to the central axis thereof and angularly displaced from respective, said plural resilient biasing means.

8. A combustor cowl according to claim 1, wherein a first weld integrally joins the corresponding edges of the respective fore ends and a second weld integrally joins the respective aft ends of the first and second plies of sheet metal.

9. A combustor cowl according to claim 1, wherein:

the combustor is of generally annular configuration and comprises inner and outer generally cylindrical liners having respective fore ends and aft ends and commonly defining the central cowl axis;

the combustor cowl comprises inner and outer cowl portions, each being of said generally annular configuration and commonly defining the central cowl axis; and the corresponding trailing edges of the inner and outer cowl portions are connected to the fore ends of the respective inner and outer combustor liners.

10. A combustor cowl according to claim 9, wherein:

the outer cowl portion has a convex, aerodynamically contoured configuration oriented in a radially outward direction relative to the central cowl axis;

the inner cowl portion has a convex, aerodynamically contoured configuration oriented in a radially outward direction relatively to the central cowl axis; and the respective leading edges of the inner and outer cowl portions define an annular opening therebetween which is smaller than the annular opening defined between the respective trailing edges thereof.

11. A combustor cowl according to claim 9, further comprising: elongated spring means of generally arcuate configuration, received in and maintained in compression within the curled leading edge of the cowl and thereby providing further frictional damping of vibration induced in the cowl during normal operating conditions of the gas turbine engine.

12. A combustor cowl according to claim 11, wherein the spring means comprises a hollow, generally elongated cylindrical tube defining a central tube axis and having a slit in the cylindrical sidewall thereof so as to define a C-shape in cross-section in a plane transverse to the central tube axis, the hollow tube being shaped to assume a generally arcuate configuration and extent corresponding substantially to the arcuate configuration and extent of the curled leading edge of the combustor cowl, the hollow tube being press fit into the curled leading edge of the combustor cowl and being compressed thereby so as substantially to close the slit in the sidewall of the hollow tube and thereby maintain same under compression.

13. A combustor cowl for use in assembled relationship with the combustor of a gas turbine engine, the cowl being of a generally annular configuration defining a central cowl axis and being axially elongated and aerodynamically contoured relative to the central cowl axis, the combustor defining a central combustor axis and the central cowl and combustor axes being aligned in the assembled relationship of the combustor cowl with the combustor, the combustor cowl comprising:

a ply of sheet metal of said generally annular, axially elongated and aerodynamically contoured configuration and having inner and outer main surfaces and fore and aft end portions, the fore end portion being curled in a direction toward the inner main surface thereof, thereby to form a leading edge of the cowl of a generally circular configuration in a plane transverse to the central cowl axis and of a generally arcuate cross-section in a plane extending radially from the central cowl axis, and the aft end defining a trailing edge of the cowl; and elongated spring means of generally arcuate configuration, received in and maintained in compression within, and thereby in surface contact with, the inner surface of the curled, leading edge of the cowl and thereby providing frictional damping of vibration induced in the cowl during normal operating conditions of the gas turbine engine.

14. A combustor cowl according to claim 13, wherein the spring means comprises a hollow, generally elongated cylindrical tube defining a central tube axis and having a slit in the cylindrical sidewall thereof so as to define a C-shape in cross-section in a plane transverse to the central tube axis, the hollow tube being shaped to assume a generally arcuate configuration and extent corresponding substantially to the arcuate configuration and extent of the curled leading edge of the combustor cowl, the hollow tube being press fit into the curled leading edge of the combustor cowl and being compressed thereby so as substantially to close the slit in the sidewall of the hollow tube and thereby maintain same under compression.

* * * * *